US011814263B2

(12) United States Patent
Bütler et al.

(10) Patent No.: US 11,814,263 B2
(45) Date of Patent: Nov. 14, 2023

(54) COUNTERWEIGHT FOR AN ELEVATOR SYSTEM AND ELEVATOR SYSTEM EQUIPPED WITH THE COUNTERWEIGHT

(71) Applicant: Inventio AG, Hergiswil (CH)

(72) Inventors: Erich Bütler, Ebikon (CH); Peter Möri, Rothenburg (CH); Romeo Lo Jacono, Gravesano (CH)

(73) Assignee: INVENTIO AG, Hergiswil (CH)

( * ) Notice: Subject to any disclaimer, the term of this patent is extended or adjusted under 35 U.S.C. 154(b) by 143 days.

(21) Appl. No.: 17/309,484

(22) PCT Filed: Dec. 17, 2019

(86) PCT No.: PCT/EP2019/085699
§ 371 (c)(1),
(2) Date: Jun. 1, 2021

(87) PCT Pub. No.: WO2020/127303
PCT Pub. Date: Jun. 25, 2020

(65) Prior Publication Data

US 2022/0041407 A1 Feb. 10, 2022

(30) Foreign Application Priority Data

Dec. 20, 2018 (EP) ..... 18214772

(51) Int. Cl.
*B66B 17/12* (2006.01)
*B66B 7/02* (2006.01)

(52) U.S. Cl.
CPC ..... *B66B 17/12* (2013.01); *B66B 7/02* (2013.01); *B66B 7/022* (2013.01)

(58) Field of Classification Search
CPC ..... B66B 7/021; B66B 7/022; B66B 7/024; B66B 17/12
See application file for complete search history.

(56) References Cited

U.S. PATENT DOCUMENTS

| | | | | |
|---|---|---|---|---|
| 3,211,259 | A * | 10/1965 | Tofanelli | B66B 7/022 187/408 |
| 6,035,974 | A * | 3/2000 | Richter | B66B 7/022 187/404 |
| 2011/0168500 | A1 | 7/2011 | Rossignol | |
| 2014/0284148 | A1 * | 9/2014 | Albu | B66B 17/12 187/404 |

FOREIGN PATENT DOCUMENTS

| | | |
|---|---|---|
| CN | 101134548 A | 3/2008 |
| CN | 202186813 U | 4/2012 |
| CN | 104709797 A | 6/2015 |
| CN | 108349700 A | 7/2018 |

(Continued)

*Primary Examiner* — Minh Truong
(74) *Attorney, Agent, or Firm* — William J. Clemens; Shumaker, Loop & Kendrick, LLP

(57) ABSTRACT

A counterweight for an elevator system has an asymmetrical cross section in a horizontal sectional plane. The asymmetrical cross section results in an improved connection of the counterweight to a guide rail, a reduction in a number of components, in particular guide rails, for the elevator system, and a reduction in an installation space for the elevator system thereby simplifying installation of the elevator system.

13 Claims, 4 Drawing Sheets

(56) References Cited

FOREIGN PATENT DOCUMENTS

| | | | | | |
|---|---|---|---|---|---|
| CN | 108584647 | A | * | 9/2018 | |
| CN | 109132797 | A | * | 1/2019 | ..... B66B 11/00 |
| DE | 20105144 | U1 | | 7/2001 | |
| EP | 1149795 | A1 | | 10/2001 | |
| EP | 1149795 | B1 | | 1/2006 | |
| EP | 1894876 | A1 | | 3/2008 | |
| GB | 2575042 | A | | 1/2020 | |
| JP | S62194673 | U | | 12/1987 | |
| JP | H0489787 | A | | 3/1992 | |
| JP | 2012224472 | A | | 11/2012 | |
| KR | 101216047 | B1 | * | 12/2012 | ..... B66B 17/12 |
| WO | WO-2005037704 | A1 | * | 4/2005 | ..... B66B 17/12 |
| WO | WO-2006035257 | A1 | * | 4/2006 | ..... B66B 17/12 |
| WO | 2009034068 | A1 | | 3/2009 | |
| WO | 2018096645 | A1 | | 5/2018 | |
| WO | WO-2018096645 | A1 | * | 5/2018 | ..... B66B 11/00 |
| WO | WO-2022136119 | A1 | * | 6/2022 | |

* cited by examiner

COUNTERWEIGHT FOR AN ELEVATOR SYSTEM AND ELEVATOR SYSTEM EQUIPPED WITH THE COUNTERWEIGHT

FIELD

The present invention relates to an elevator system. In particular, the invention relates to a counterweight for an elevator system.

BACKGROUND

In an elevator system, an elevator car is typically moved vertically along a travel path between different floors or levels within a structure. At least in tall buildings, an elevator type is usually used in which the elevator car is held by rope or belt-like suspension elements and displaced within an elevator shaft by moving the suspension elements by means of a drive machine. In order to at least partially compensate for the load of the elevator car to be moved by the drive machine, a counterweight is usually attached to an opposite end of the suspension elements. This counterweight has at least the same mass as the elevator car. As a rule, the mass of the counterweight exceeds that of the elevator car by half of the payload that is permissible to be transported by the elevator car. Depending on the type of elevator, a plurality of counterweights and/or a plurality of elevator cars can also be provided in an elevator system.

Conventionally, both the elevator car and the counterweight have an essentially cuboid geometry. An example of a correspondingly designed elevator system is described in EP 1894876 A1.

When designing an elevator system, the objective is generally to keep a base surface or a "footprint" of the elevator system as small as possible. In this case, the base surface can refer to a cross-sectional surface along a horizontal plane that has to be provided in a building for accommodating the elevator system. The total base surface to be provided depends, among other things, on a base surface of the elevator car, a base surface of the counterweight and possibly a base surface required for elevator components, by means of which, for example, the elevator car and the counterweight can be held within the elevator shaft and/or guided during their displacement movements.

The portion of the base surface to be provided for the elevator car usually results inevitably from a conveying capacity specified for the elevator system to be designed, i.e., a number of persons to be accommodated in the elevator car.

For the portion of the base surface that is to be provided for the counterweight, various approaches have so far been implemented in order to minimize said portion.

For example, it was possible to keep the base surface of the counterweight small and a height of the counterweight, i.e., a dimension of the counterweight orthogonal to said base surface, dimensioned to be large in order to give the counterweight overall sufficient volume, so that it can be designed with a mass sufficient to compensate for the car load. In this case, the height of the counterweight was possibly greater than the height of the elevator car. However, with such a configuration of the counterweight, sufficient height also had to be available in the elevator shaft in order to be able to accommodate the counterweight in any position into which it could be moved during the operation of the elevator system.

As a complementary or alternative approach, it was possible to use counterweights made of a material with a particularly high density. For example, counterweights were made of steel instead of concrete, so that they could have a significantly smaller volume with the same mass. However, this results in significantly higher total costs for the elevator system due to the higher material costs.

SUMMARY

Among other things, there can be a demand for a counterweight and an elevator system equipped with said counterweight, in which a base surface and/or space requirement for the elevator system is low and overall costs for the elevator system can nevertheless be kept low. Furthermore, there can be a demand for a counterweight and an elevator system equipped with said counterweight, in which a number of elevator components used to hold and guide the counterweight can be kept small and an installation effort and expenditures can be reduced.

At least one of the demands mentioned can be met with the subject matter according to the advantageous embodiments defined in the following description.

According to a first aspect of the invention, a counterweight for an elevator system is proposed. In this case, the counterweight has an asymmetrical cross section in a horizontal sectional plane.

According to a second aspect of the invention, an elevator system is proposed which has at least one elevator car, at least one guide rail and at least one counterweight according to an embodiment of the first aspect of the invention.

Possible features and advantages of embodiments of the invention can be considered, among others and without limiting the invention, to be based on the concepts and findings described below.

As stated above, conventional counterweights in elevator systems have so far had mostly an essentially cuboid geometry. In this case, a counterweight had a rectangular base surface. In other words, the cross section of the counterweight in a horizontal sectional plane was rectangular. Such a rectangular cross section has mirror symmetries. Counterweights with such a simple geometry can be manufactured with little effort.

However, it has now been found that, in an elevator system in which one or more cuboid counterweights are used, an installation space often cannot be advantageously minimized, taking into account the maximum costs to be observed.

It is therefore proposed to modify the geometry of the counterweight such that it no longer has a symmetry in its cross section aligned in the horizontal sectional plane. In particular, the counterweight is not supposed to have any mirror symmetry or any rotational symmetry in said horizontal cross section. For this purpose, the deviation from the symmetry is supposed to exceed negligible dimensions. In particular, the surface of the asymmetrical cross section is supposed to deviate from a symmetrical cross section by more than 5%, preferably more than 10%. In this case, the asymmetry relates purely to the geometry, i.e., not to weight distributions within the counterweight.

As will be described in more detail below, such a deviation from a symmetrical configuration allows for the geometry and in particular the horizontal cross section of the counterweight to be designed such that the space required for the counterweight and in particular the base surface required for the counterweight can not only be kept small but can also be adapted to free volumes or free base surfaces which are available in the elevator shaft of the elevator system. In particular, the asymmetrical configuration of the counterweight makes it possible to accommodate the counterweight in a space-saving manner in those regions of an elevator shaft which are neither required for the elevator car nor necessarily for other components of the elevator system.

The counterweight proposed herein generally has two opposite end faces, two opposite longitudinal flanks and two opposite top surfaces. The two end faces can be planar. Furthermore, the two end faces can run parallel to one another. In principle, the two longitudinal flanks could also be planar, but it can be preferred to not design at least one of the two longitudinal flanks in a planar manner. In particular, it can be preferred that the two longitudinal flanks do not run parallel to one another, at least in partial regions. Both the end faces and the longitudinal flanks generally extend in the vertical direction. For this purpose, each of the longitudinal flanks runs from an edge of a first end face to an edge of the opposite second end face. The top surfaces can be planar and/or run parallel to one another. The top surfaces generally extend in the horizontal direction or in a horizontal plane.

Overall, the proposed counterweight is not cuboid. Instead, the geometry of the counterweight can differ significantly from a cuboid shape, in particular due to a non-planar configuration of at least one of its longitudinal flanks and/or a configuration of its two longitudinal flanks in which they are not parallel to one another.

According to one embodiment, the counterweight has a greater first width on a first end face than a second width on an opposite second end face.

In other words, the counterweight is designed asymmetrically such that it is wider on the first end face than on the second end face. The first width can be, for example, at least 10%, preferably at least 20% or at least 30% or even at least 50% wider than the second width. In this case, the counterweight can be "L"-shaped in cross section. In this case, the width is measured in the horizontal sectional plane in a direction parallel to one of the end faces.

Due to the fact that the counterweight is less wide on its second end face, other components of the elevator system can be accommodated in the elevator shaft on this end face adjacent to the counterweight. However, a part of the counterweight located on the wider first end face can have a relatively large volume, so that this part of the counterweight can have a considerable mass.

According to one embodiment, the counterweight has two opposite longitudinal flanks, which each extend between the first end face and the second end face. At least one of these longitudinal flanks can be designed to be concave.

In other words, at least one of the longitudinal flanks of the counterweight, which connect the first end face to the second end face, can be designed to be concave rather than planar. In this context, "concave" can refer to a geometric configuration in which the respective longitudinal flank is indented inwardly, i.e., towards the opposite longitudinal flank, deviating from a planar configuration. In other words, the concave longitudinal flank runs closer to the opposite longitudinal flank than a virtual planar longitudinal flank used for comparison, which connects the same edges of the end faces to one another. In particular, it can be preferred that the longitudinal flank of the counterweight, which faces towards the elevator car, is designed to be concave.

Due to the concave design of at least one of the longitudinal flanks of the counterweight, a type of recess can be created in the region of the counterweight, in which other components of the elevator system, i.e., in particular, for example, a guide rail and/or a strut holding the guide rail, can be accommodated.

According to one embodiment, the counterweight has first and second longitudinal flanks which each extend between first and second end faces. The first longitudinal flank runs essentially as a plane from the first end face to the second end face and, in particular, the first longitudinal flank is essentially perpendicular to the first end face and to the second end face.

The end face describes those surfaces of the counterweight which have a maximum distance from one another along a longer main axis of the cross section in a horizontal sectional plane. In particular, the end faces are free of additional construction elements. The two end faces and the straight longitudinal flank are designed to be planar. Preferably, three shaft walls are each parallel to one of the end faces or the longitudinal flank. In order to optimally utilize the shaft, it is advantageous that the shaft walls each have the same, preferably minimal, tolerance distance from the end faces or the longitudinal flank. Therefore, the two end faces and the longitudinal flank fit with a tolerance distance in a region of the elevator shaft that spans over three shaft walls.

The two longitudinal flanks are preferably parallel to one another in a region adjoining the first end face.

The two longitudinal flanks are preferably parallel to one another in a region adjoining the second end face.

For example, according to one embodiment, an intermediate region can be formed on the counterweight between the first end face and the second end face, in which the counterweight has a smaller width than the first width. In this intermediate region, a holding device can be arranged on the counterweight, by means of which the counterweight can be attached to a guide rail and moved along the guide rail in a guided manner.

In other words, at least one of the longitudinal flanks of the counterweight can be designed such that a type of indentation is formed in the counterweight in said intermediate region away from its first end face. At the indentation in the intermediate region, the counterweight has a smaller thickness than at its first end face. Therefore, space remains in said indentation in order to be able to accommodate a guide rail therein. The guide rail is intended to hold or support the counterweight. In particular, the guide rail is supposed to be designed such that the counterweight, when it is displaced vertically in the elevator shaft, is held on and guided by the guide rail.

In order to be able to attach the counterweight to and guide it along the guide rail, a special holding device is provided on the counterweight in the indentation formed in the intermediate region. This holding device can, for example, interact interlockingly with the guide rail and be designed such that the counterweight is held on the guide rail via the holding device and, guided by the guide rail, can be displaced along a planned travel path.

According to a specific embodiment, the counterweight can have an oblique surface in the intermediate region, which is oriented obliquely with respect to a shortest connecting line between the first and the second end face.

In other words, the counterweight can be configured on its concave longitudinal flank in the intermediate region such that a part of the surface of the counterweight running in said region is aligned obliquely. In this context, "oblique" can be understood to mean that the respective longitudinal flank does not connect the wider first end face along a shortest connecting line to the narrower second end face but instead has a concave indentation in which the part of the surface of the counterweight running therein is not aligned along said shortest connecting line but obliquely thereto. In this case, the oblique surface can be planar. Alternatively, the oblique surface can also be slightly curved as long as it runs obliquely in the geometric mean with respect to said shortest connecting line.

With the oblique surface or via a holding device attached in the region of this oblique surface, the counterweight can interact with a surface of a guide rail which is also aligned obliquely and preferably runs parallel to the oblique surface of the counterweight. Due to the oblique alignment of these surfaces, the guiding properties of the guide rail can be improved with respect to the counterweight guided thereon. In particular, it can be achieved that the counterweight can neither be moved freely parallel to one of its end faces nor parallel to the longitudinal flanks. Instead, the counterweight can be held on the obliquely running surface of the guide rail in the two directions which are perpendicular to one another. In this way, the counterweight can be prevented, for example, from unwanted lateral swinging within the elevator shaft.

According to a further specific embodiment, the single holding device of the counterweight is arranged exclusively in the region of the oblique surface.

As a result, the counterweight can be easily guided on a single rail.

According to a further specific embodiment, the holding device can be configured to hold the counterweight in at least two spatially separated positions on the guide rail and to guide it along at least two spatially separated guide tracks.

In other words, the holding device can not only hold the counterweight at a single position on the guide rail and guide it along a single guide track along the guide rail. Instead, the holding device can be designed such that the counterweight can be held by the holding device at two laterally spaced-apart positions and is guided by the holding device during a vertical movement along two laterally spaced-apart guide tracks.

Such a configuration allows the holding device to hold the counterweight reliably on the guide rail and thereby guide it with respect to two directions that are not parallel to one another. In this way, the holding device can preferably prevent the counterweight from leaving a vertical travel path in different lateral directions. It also prevents the counterweight from rotating about a vertical axis; this takes place all the more efficiently the further the two guide tracks are spaced apart from one another.

According to one embodiment, the counterweight can be formed predominantly with a first material in a first region in which it has a greater width and predominantly with a second material in a second region in which it has a smaller width. In this case, the second material has a greater density than the first material. For example, the second material can have a density that is at least 50%, preferably at least 100%, greater than that of the first material. For example, the first material can be concrete and the second material can be a metal, in particular steel.

The following embodiment can also be considered to be a separate invention. In this case, a counterweight for an elevator system has an asymmetrical cross section in a horizontal sectional plane. The counterweight is formed predominantly with a first material in a first region in which it has a greater width and predominantly formed with a second material in a second region in which it has a smaller width. This invention can be combined with the other features of this application.

In other words, the counterweight can be viewed as being composed of at least two regions. In the first region, the counterweight has a greater width which can, for example, correspond to the above-mentioned first width on the first end face. In the second region, the counterweight has a smaller width which can, for example, correspond to the above-mentioned second width on the second end face. The width of the counterweight can be constant within one of these regions. Alternatively, the width of the counterweight can vary within one or both regions, in which case at least an average width in the first region is greater than an average width in the second region.

If the two regions have approximately the same length and height, the different widths result in a larger volume for the first region than for the second region. In the event that the two regions were made of the same material, the result would be an inhomogeneous weight distribution along a longitudinal direction of the counterweight.

In order to make the weight distribution within the counterweight more homogeneous, a denser material can be used in the second region with the smaller volume than in the larger first region. Due to the use of this denser material, the second region, despite its smaller volume, can have a similar or even the same weight as the first region.

For example, the second region can be predominantly or even completely formed of metal, in particular, for example, of steel with a density of, for example, approximately 7.9 $g/cm^3$, whereas the first region can be predominantly or even completely formed of concrete, which typically has a density of 2 to 3 $g/cm^3$.

Due to the use of different materials in the counterweight and the uneven distribution of these materials within the counterweight, the asymmetrical geometric design of the counterweight can at least partially be balanced, so that a largely balanced weight distribution with reference to the central axis, which runs parallel to the end faces of the counterweight and is arranged at the transition between the first region and the second region, can be achieved. In other words, by using materials of different densities in the two regions, it can be achieved that a center of gravity of the counterweight is approximately where the first region adjoins the second region, despite differently large volumes of the two regions.

Such a homogenization of the weight distribution within the counterweight can be used to the effect that the counterweight can be attached to and guided along a guide rail, for example, by means of a holding device which is attached to the counterweight approximately where the first region adjoins the second region. This position can thus correspond to the intermediate region described above. In particular, this position can be arranged approximately centrally on the counterweight in the longitudinal direction, i.e., it can be arranged within, for example, 20% or within, for example, 10% of either side of the geometric center of the counterweight in its longitudinal direction.

With such an approximately central arrangement and a homogenization of the weight distribution effected as proposed in the asymmetrical counterweight, it can be achieved that no or only small torques or tilting moments are exerted on the holding device. Mechanical loads on the holding device and on the guide rail interacting with the holding device can thus be kept low.

For an elevator system according to one embodiment of the second aspect of the invention, the described asymmetrical counterweight can advantageously be used in several ways.

For example, the use of the asymmetrical counterweight can allow for the counterweight to be arranged in the elevator system in a particularly space-saving manner and thus allow for a small installation space for the elevator system.

In particular, according to one embodiment, the counterweight and a strut, which anchors a guide rail holding the counterweight in a guiding manner on an elevator shaft wall, can each have an outer contour in a cross section along a horizontal sectional plane, wherein a minimally large first virtual rectangle which surrounds the outer contour of the counterweight and a minimally large second virtual rectangle which surrounds the outer contour of the strut overlap one another.

The following embodiment can also be considered to be a separate invention. The elevator system has the counterweight having an asymmetrical cross section in a horizontal sectional plane. The elevator system further comprises a strut which anchors a guide rail holding the counterweight in a guiding manner on an elevator shaft wall. The strut and the counterweight have an outer contour in a cross section along a horizontal sectional plane, wherein a minimally large first virtual rectangle which surrounds the outer contour of the counterweight and a minimally large second virtual rectangle which surrounds the outer contour of the strut overlap one another.

In other words, a guide rail within the elevator system can be anchored laterally on an elevator shaft wall of the elevator shaft by means of a mostly horizontally running strut. For this purpose, both the strut and the guide rail have a specific outer contour in a horizontal cross section, i.e., projected onto a horizontal plane. This outer contour can but need not necessarily be rectangular. However, a smallest possible rectangle, i.e., a rectangle completely enveloping the outer contour but of minimally large size, can be placed around each outer contour. Even though the counterweight itself also does not have a rectangular cross section, it can be enveloped in a similar manner by a minimally large rectangle. In this rectangle, referred to as the first rectangle, partial regions remain that are not filled by the asymmetrical counterweight. In particular, said strut and preferably also the guide rail can be accommodated at least partially or even completely in these otherwise empty partial regions. In other words, the minimally large rectangle enveloping the strut and the minimally large rectangle enveloping the counterweight can at least partially overlap one another. As a result, the overall space required for these two elevator components can be minimized.

Furthermore, according to one embodiment, both the at least one elevator car and the at least one counterweight can be held on the guide rail such that they are guided in a displacement movement along the guide rail.

In other words, the elevator system can be equipped with one or more guide rails, wherein both a counterweight and an elevator car are held on a single guide rail and guided in their movement along the guide rail. This is made possible in particular by the special design of the counterweight proposed herein. As a result, a number of guide rails to be kept available in the elevator system can be reduced, thus reducing both the costs for the elevator system and the effort involved in its installation.

In particular, according to one embodiment, a number of guide rails can be equal to a number of counterweights.

In other words, for example, a single counterweight can be held on and displaced along a single guide rail in a guided manner. In particular, the elevator system can be equipped with two separate counterweights and, correspondingly, with two separate guide rails. Each of the counterweights can be held and guided on only one of the guide rails. The travel path of the elevator car can be located between the two guide rails. In other words, the travel paths of the two counterweights can each run on opposite sides next to the travel path of the elevator car. The elevator car can preferably be held and guided on the same guide rails as the counterweights. Overall, the number of guide rails to be kept available and installed can thus be reduced.

In particular, in order to be able to keep a counterweight advantageously guided on only a single guide rail, the guide rail according to one embodiment can have two guide tracks that are spatially separated from one another and face in different directions. In this case, a holding device with two guide shoes can be formed on the counterweight, wherein each of the guide shoes is configured to support the counterweight on the guide rail and to interact with the guide rail to guide the counterweight on one of the guide tracks.

In other words, a single guide rail can be structurally designed such that two guide tracks running vertically and spaced apart from one another on said guide rail are formed thereon. For this purpose, the two guide tracks are aligned in different directions, i.e., the surfaces formed by the respective guide tracks face in non-parallel directions. In order to interact with said guide tracks, a holding device with two correspondingly aligned guide shoes can then be formed on the counterweight. In this case, each of the guide shoes is suitably designed and aligned to support itself and the counterweight connected thereto along one of the guide tracks on the guide rail. In addition, the guide shoes are each suitably designed to hold the counterweight guided along the respective guide tracks on the guide rail during a vertical movement.

Due to the fact that the two guide tracks are aligned in different directions and the two holding devices each interact with one of the guide tracks, the counterweight is not only guided laterally in a single direction but is also guided in two directions not parallel to one another. As a result, a more stable lateral guidance can be achieved overall when the counterweight is movingly displaced.

According to a further embodiment, the counterweight can have a height, measured in a direction parallel to a longitudinal extension direction of the guide rail, which is less than or equal to 130%, preferably less than or equal to 110% or even less than or equal to 100%, of a height of the elevator car.

In other words, the counterweight can have a height which is at most slightly greater than the height of the elevator car. Preferably, the height of the counterweight is at most the same as the height of the elevator car.

Assuming that the travel paths of the elevator car and the counterweight are of the same length, it can be achieved that a height of the elevator shaft of an elevator system essentially only needs to be dimensioned based on the length of the travel path of the elevator car and the height of the elevator car.

In particular, the elevator shaft does not have to be provided with a greater height, as in some conventional elevator systems, only to be able to accommodate a counterweight whose height is significantly greater than that of the elevator car in order to be able to achieve sufficient mass for the counterweight at a small base surface.

As a result of the asymmetrical design of the counterweight, an optimized utilization of the cross section available in an elevator shaft can thus be achieved. The asymmetrical counterweight can utilize or fill as optimally as possible the regions of a base surface not to be kept free for the elevator car or other elevator components in the elevator shaft. In this case, the base surface of the counterweight can be relatively large. In this way, the counterweight can also acquire sufficient mass even with a relatively small height of, for example, less than 2.5 m in order to largely compensate for the load generated by the elevator car and its possible payload.

It must be noted that some of the possible features and advantages of the invention are described herein with reference to different embodiments of the counterweight and the elevator system equipped with said counterweight. A person skilled in the art recognizes that the features can be combined, adapted, or exchanged in a suitable manner in order to arrive at further embodiments of the invention.

In the following, embodiments of the invention will be described with reference to the attached drawings, wherein neither the drawings nor the description are to be interpreted as delimiting the invention.

The drawings are merely schematic and not true to scale. The same reference signs refer to the same or similarly functioning features in the various figures.

DETAILED DESCRIPTION

Figure 1:
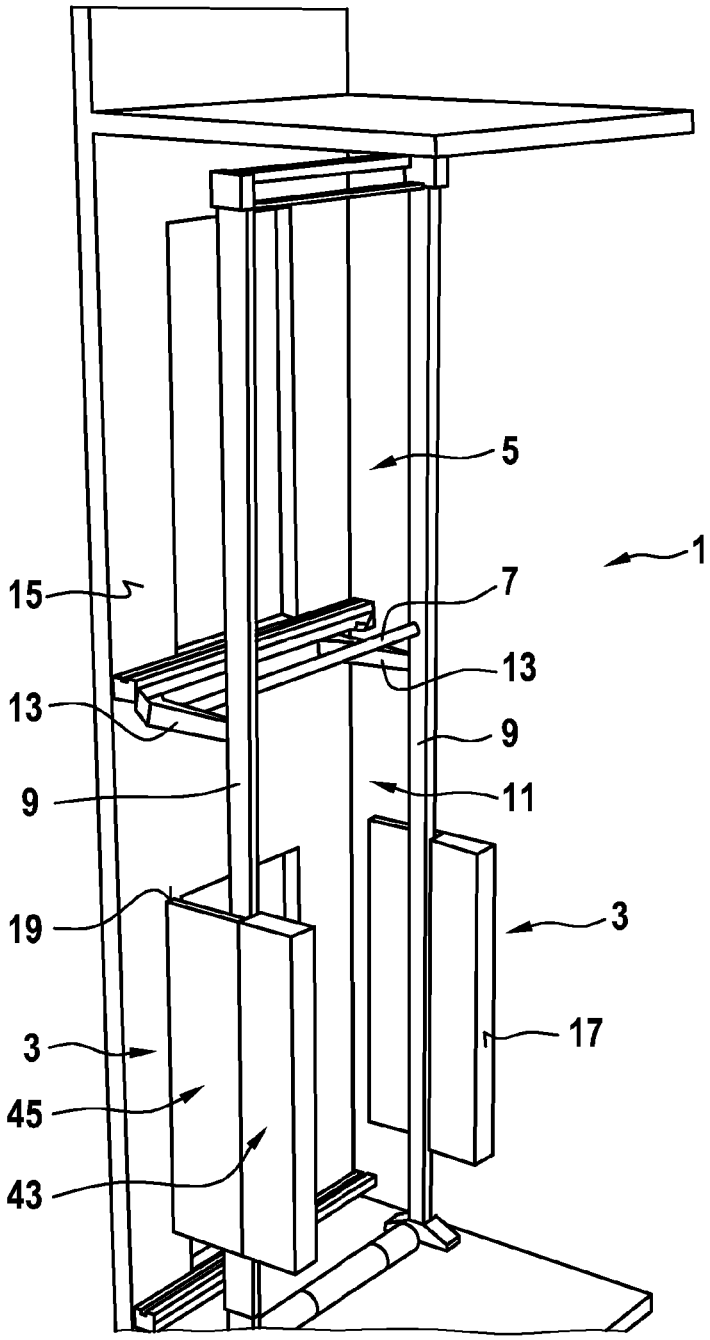
FIG. 1 is a perspective view of an elevator system according to one embodiment of the invention.

FIG. 1 shows an elevator system 1 according to one embodiment of the present invention. The elevator system 1 comprises as essential components two counterweights 3 and an elevator car 5 (for reasons of clarity, only the frame 7 holding the elevator car 5 is shown) as well as two guide rails 9. The guide rails 9 extend vertically along essentially an entire elevator shaft 11 and are anchored to an elevator shaft wall 15 of the elevator shaft 11 with horizontally running struts 13. Each of the two counterweights 3 is held on only one of the guide rails 9 and is guided by said guide rail vertically through the elevator shaft 11 during a displacement movement. In the depicted elevator system 1, a number of counterweights 3 and a number of guide rails 9 are thus the same. The elevator car 5 is accommodated in a region between the two guide rails 9 and is held and guided by both guide rails 9.

Figure 2:
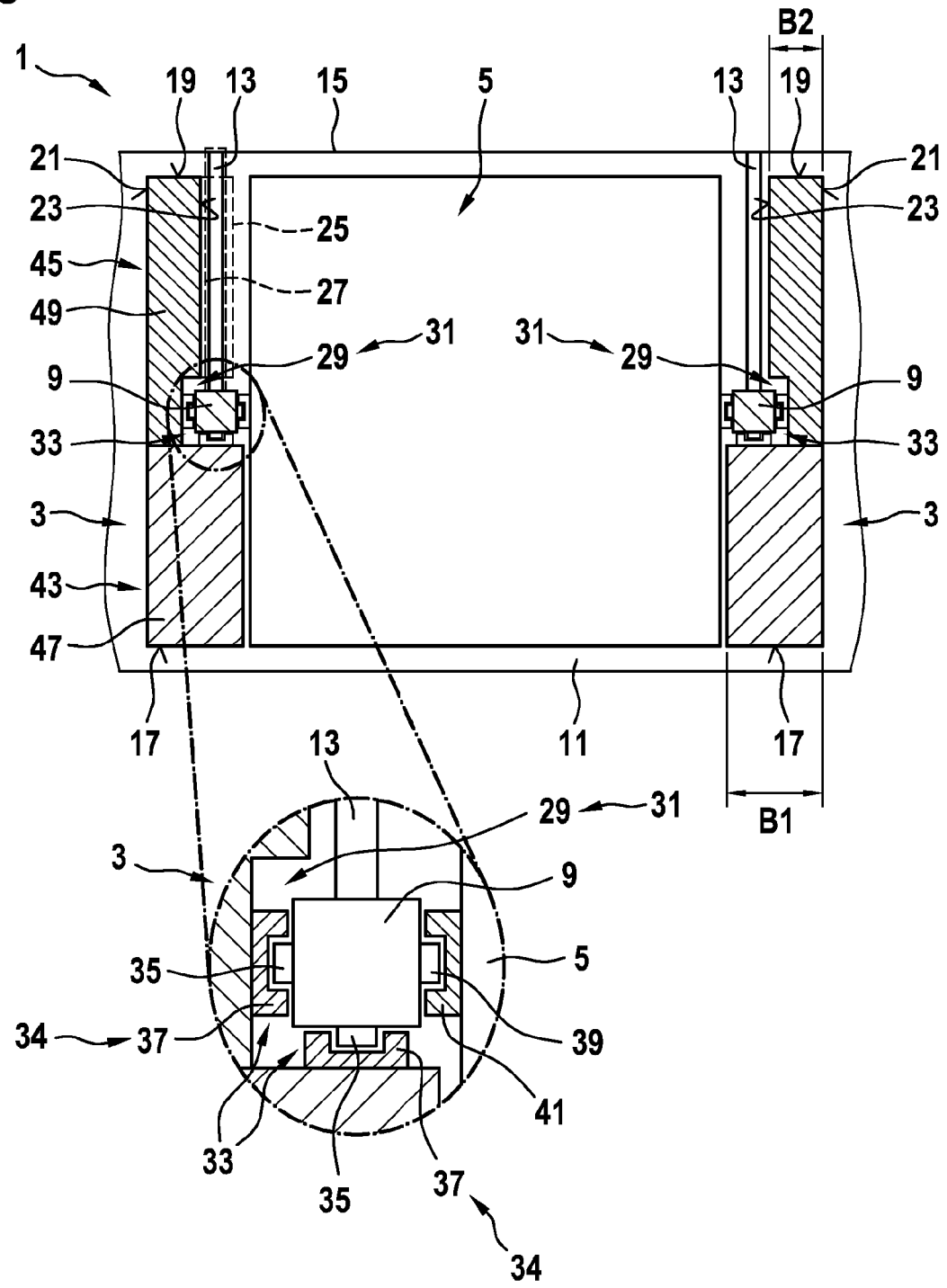
FIG. 2 is a cross-sectional view in a horizontal sectional plane of an elevator system according to one embodiment of the invention.

FIG. 2 is a cross-sectional view in a horizontal sectional plane of the elevator system 1. Alternatively, FIG. 2 can also be viewed as a projection of the essential components of the elevator system 1 accommodated in the elevator shaft 11 onto a horizontally running plane.

The elevator car 5 is essentially cuboid and thus has a rectangular base surface. In the depicted example, the elevator car 5 is arranged centrally in the elevator shaft 11. One of each of the guide rails 9 is arranged on the two opposite sides of the elevator car 5. In the example shown in FIG. 2, each guide rail 9 has a rectangular cross-sectional shape. Each of the guide rails 9 is anchored horizontally on the elevator shaft wall 15 via a straight strut 13. One counterweight 3 each is also arranged on both opposite sides of the elevator car 5.

In this case, each of the counterweights 3 has a non-cuboid geometry and thus has a non-rectangular base surface. The counterweights 3 are thus asymmetrical in cross section with respect to the depicted horizontal sectional plane. In this case, the cross section of the counterweights 3 in the depicted example is approximately "L"-shaped. Alternatively, the cross section of the counterweights 3 can also be viewed as approximately "C"-shaped, wherein the upper limb of the "C" in FIG. 2 is significantly shorter than the lower limb of the "C" parallel to it. In both cases, the length of a horizontal limb of the "L" or "C" corresponds to the respective width of the counterweight.

On a first end face 17, the counterweight 3 has a significantly larger first width B1 than on an opposite second end face 19, on which a second width B2 is, for example, at least 20% smaller than the first width B1.

Each of the counterweights 3 has an outer longitudinal flank 21 and an inner longitudinal flank 23 which extend between the two opposite end faces 17, 19. In the depicted example, the outer longitudinal flank 21 is planar. However, the inner longitudinal flank 23 is in each case designed to be concave.

Due to the proposed asymmetrical design of the counterweights 3, the counterweights 3 can advantageously be accommodated in a partial volume of the elevator shaft 11, which is neither occupied by the elevator car 5 nor, for example, by the struts 13 or the guide rails 9 anchored with said struts.

In other words, a minimally large first virtual rectangle 25 (indicated by dashed lines in the figure) can be assumed enveloping the outer contour of one of the counterweights 3, and a minimally large second virtual rectangle 27 can be assumed enveloping the outer contour of the adjacent strut. In contrast to conventional elevator systems, in which counterweights have a rectangular outer contour and corresponding enveloping virtual rectangles and thus require corresponding space separate from other elevator components within the elevator shaft, the first and the second of said virtual rectangles 25, 27 can overlap one another in the elevator system 1 proposed herein. In particular, the strut 13 can be arranged in a tapered partial region of the counterweight 3, i.e., where the counterweight 3 has the smaller second width B2 due to the concave design of its inner longitudinal flank 23. However, where space is no longer required for the strut 13 within the elevator shaft 11 because it only extends approximately into the center of the elevator shaft 11, the counterweight 3 can be designed with the larger first width B1, thus making more volume and ultimately more mass possible for the counterweight 3.

A recess 29 is formed on the inner longitudinal flank 23 of the counterweight 3 approximately in the region of the geometric center of the longitudinal flank 23. This recess 29 can also be viewed as an intermediate region 31 in which the counterweight 3 has a smaller width than the first width B1. A holding device 33 is arranged on the counterweight 3 in this intermediate region 31. The counterweight 3 is attached to the respectively adjacent guide rail 9 via the holding device 33 and can be moved in a guided manner along the guide rail 9.

As can be clearly seen in the enlarged section from FIG. 2, the guide rail 9 has two guide tracks 35 that are spatially separated from one another and face in different directions. In the depicted example, the two guide tracks 35 are aligned at a 90° angle to one another, i.e., they are arranged on flanks of the guide rail 9, which are square in profile and run perpendicular to one another.

For this purpose, the holding device 33 has two guide shoes 34 which can be designed, for example, as sliding shoes 37. Each of the sliding shoes 37 is designed to interact with one of the guide tracks 35 and in this way support the counterweight 3 via the sliding shoe 37 and the guide track 35 on the guide rail 9 and to interact with the guide rail 9 such that the counterweight 3 is guided along the respective guide track 35 during a vertical movement. In the depicted example, the two sliding shoes 37, similar to the guide tracks 35, are aligned at a 90° angle to one another.

The holding device 33 is thus designed to hold the counterweight 3 in at least two spatially separated positions on the guide rail 9 and to guide it along the at least two spatially separated guide tracks 35.

In a similar manner, the elevator car 5 is also held on the same guide rails 9 via a sliding shoe 41 which interacts with a guide track 39 on the guide rail 9 and is moveable along said guide rails in a guided manner.

The asymmetrical counterweight 3 can be viewed as being composed of at least two regions 43, 45. In a first region 43, the counterweight 3 has a greater width, for example, the first width B1 as on the first end face 17. In a second region 45, the counterweight 3 has, by comparison, a smaller width. The first region 43 is at least predominantly formed with a first material 47 of relatively low density, such as concrete, whereas the second region 45 is at least predominantly formed with a second material 49 of higher density, such as metal, in particular steel.

In this way, despite the asymmetrical geometric configuration of the counterweight 3, weight ratios or a weight distribution within the counterweight 3 can be designed such that, for example, it can be avoided that excessive tilting moments or torques are exerted on the holding device 33 and, by extension, on the guide rail 9.

Figure 3:
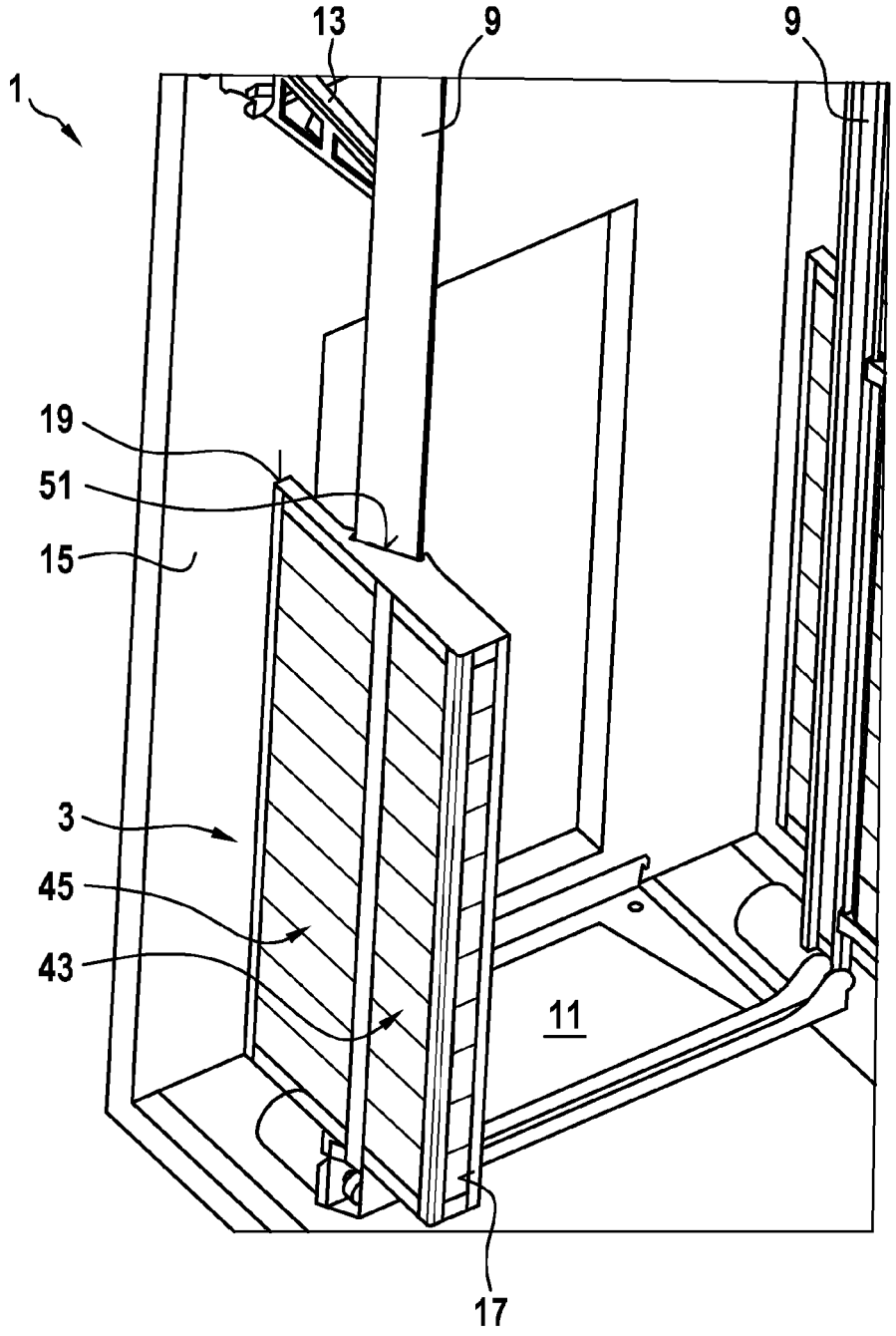
FIG. 3 is a perspective partial view of an elevator system according to an alternative embodiment of the invention.
Figure 4:
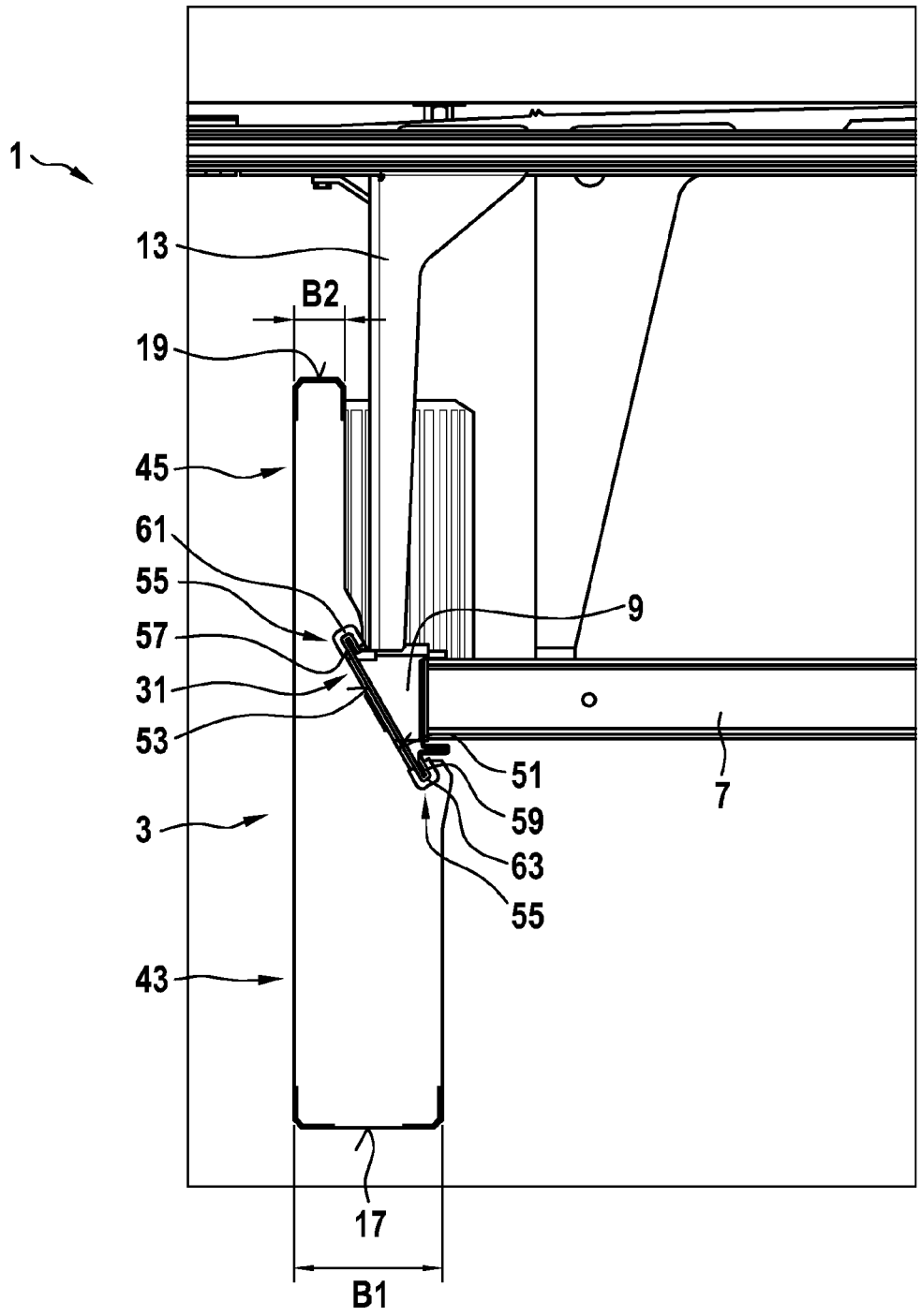
FIG. 4 is a plan view from above of a partial region of the elevator system from FIG. 3.

FIGS. 3 and 4 show an elevator system 1 with counterweights 3 in an alternative embodiment.

In this case, the counterweight 3 also has an asymmetrical cross section. However, in an intermediate region 31 between a first region 43 with the larger first width B1 adjoining the first end face 17 and a second region 45 with the smaller second width B2 adjoining the second end face 19, no steep step effecting a recess 29 is provided as in the embodiment described above. Instead, an oblique surface 51 is formed in the intermediate region 31, which runs obliquely with respect to a shortest connecting line between the first and second end faces 17, 19. Accordingly, the guide rail 9 is also not designed as a rectangular profile as in the previously described embodiment but has an equally oblique surface 53 parallel to the oblique surface 51.

In this alternative embodiment, the counterweight 3 is also held on a single guide rail 9 and is guided along these guide rails 9 during its vertical displacement. For this purpose, a holding device 55 is again provided on the counterweight 3 in the intermediate region 31. Two guide tracks 57, 59 spatially separated from one another and facing in different directions are provided on the guide rail 9. In the present case, the two guide tracks 57, 59 are aligned approximately diametrically opposed, i.e., oriented approximately at a 180° angle to one another. The counterweight 3 is held on and guided along these guide tracks 57, 59 by means of two sliding shoes 61, 63. Due to the triangular shape of the profile of the guide rails 9, the counterweight 3 can be guided in a more rigid and efficient manner.

With embodiments of the elevator system 1 proposed herein, it can be achieved that the counterweight 3 can be held and guided on a single guide rail 9, in particular due to the asymmetrical configuration of the counterweight 3 used therein. In order to increase the stability of the counterweight 3 and to take into account regulations, such as, for example, European standard EN 81-20 (5.7.1.1) with regard to the guidance of a counterweight 3 regulated therein, the counterweight 3 was designed to be concave on at least one longitudinal flank 23, so that the entire counterweight 3 is given an approximate "L" shape in the horizontal cross section. Due to said concave configuration, the counterweight 3 can interact via a holding device 33 on two surfaces with surfaces of the guide rail 9 or guide tracks 35, 39, 57, 59 provided on said guide rail. This design allows for a significantly more rigid connection between the counterweight 3 and the guide rail 9. Even though the counterweight 3 is only held and guided on a single guide rail 9, the provision of two differently aligned guide tracks 35, 39, 57, 59 allows for a more secure hold and better guidance of the counterweight 3 on the guide rail 9. Since only a single guide rail 9 for a counterweight 3 must therefore be provided and installed, costs and installation effort for the elevator system 1 can be reduced. In addition, the presented design with the asymmetrical counterweight 3 makes it possible to better use the available space within an elevator shaft 11 and, in particular, to reduce unused free spaces between the counterweight and the elevator car and possibly any other elevator components.

Finally, it should be noted that terms such as "have," "comprising," etc. do not exclude any other elements or steps, and terms such as "an" or "a" do not exclude a multiplicity. Furthermore, it should be noted that features or steps that have been described with reference to one of the above embodiments can also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A counterweight for an elevator system, the elevator system having an elevator car movable in a vertical direction along a guide rail in an elevator shaft, the counterweight comprising:

a mass of material adapted to move in the vertical direction along the guide rail and having an asymmetrical cross section shape in a horizontal sectional plane extending transverse to the vertical direction;

wherein when the counterweight is accommodated in the elevator shaft, the guide rail is positioned between the elevator car and the counterweight; wherein the counterweight has a greater first width on a first end face than a second width on an opposite second end face and the first and second end faces extend in respective vertical planes; wherein the counterweight has a first longitudinal flank and a second longitudinal flank, each of the longitudinal flanks extending between a first end face and a second end face, and wherein the first longitudinal flank runs as a plane from the first end face to the second end face, the first longitudinal flank being perpendicular to the first end face and to the second end face; an intermediate region formed in the second longitudinal flank between the first end face and the second end face, the intermediate region having a smaller width than the first width, and a holding device arranged on the counterweight in the intermediate region, the holding device adapted to attach the counterweight to the guide rail for guided movement of the counterweight along the guide rail.

2. The counterweight according to claim 1 including an oblique surface formed in the intermediate region, the oblique surface being oriented obliquely with respect to a shortest connecting line between the first end face and the second end face.

3. The counterweight according to claim 2 wherein the holding device is arranged at the oblique surface.

4. The counterweight according to claim 1 wherein the holding device is adapted to hold the counterweight in at least two spatially separated positions on the guide rail and to guide it along at least two spatially separated guide tracks on the guide rail.

5. The counterweight according to claim 1 wherein the counterweight is formed with a first material in a first region and formed with a second material in a second region, wherein the first region has a greater width than the second region, and wherein the second material has a greater density than a density of the first material.

6. The counterweight according to claim 5 wherein the first material is concrete and the second material is a metal.

7. An elevator system comprising:

an elevator car;

a guide rail, the elevator car being movable along the guide rail; and the counterweight according to claim 1 being movable along the guide rail.

8. The elevator system according to claim 7 including a strut anchoring the guide rail on an elevator shaft wall, wherein the counterweight and the strut each have an outer contour in a cross section along the horizontal sectional plane such that a minimally large first virtual rectangle surrounding the outer contour of the counterweight and a minimally large second virtual rectangle surrounding the outer contour of the strut overlap one another.

9. The elevator system according to claim 7 wherein the elevator car and the counterweight are held on the guide rail and are guided in a displacement movement along the guide rail.

10. The elevator system according to claim 7 including at least two of the guide rail and at least two of the counterweight, wherein a number of the guide rails is equal to a number of the counterweights.

11. The elevator system according to claim 7 wherein the guide rail has two guide tracks spatially separated from one another and facing in different directions, and including a holding device with two guide shoes on the counterweight, wherein each of the guide shoes supports the counterweight on the guide rail and interacts with the guide rail to guide the counterweight on one of the guide tracks.

12. The elevator system according to claim 7 wherein the counterweight has a height in a direction parallel to a longitudinal direction of the guide rail that is less than or equal to 130% of a height of the elevator car.

13. An elevator system comprising:

a pair of guide rails extending along a path of travel in an elevator shaft;

an elevator car positioned between the guide rails and guided by the guide rails during movement of the elevator car along the travel path;

a pair of counterweights each being movable along an associated one of the guide rails and positioned on the associated guide rail opposite the elevator car; and wherein each of the counterweights has an asymmetrical cross section shape in a horizontal sectional plane that extends transverse to the travel path, a first longitudinal flank and a second longitudinal flank each extending between a first end face and an opposite second end face, wherein the first longitudinal flank runs as a plane from the first end face to the second end face and is perpendicular to the first end face and to the second end face, an intermediate region formed between the first end face and the second end face and having a smaller width than a first width of the first end face, and a holding device arranged in the intermediate region and adapted to attach the counterweight to the associated guide rail to enable movement of the counterweight along the associated guide rail in a guided manner.

* * * * *